US011098456B2

(12) United States Patent
Ali et al.

(10) Patent No.: US 11,098,456 B2
(45) Date of Patent: Aug. 24, 2021

(54) GUARDRAIL TERMINAL BARRIER

(71) Applicant: OHIO UNIVERSITY, Athens, OH (US)

(72) Inventors: Muhammad Ali, Athens, OH (US); Sean R. Jenson, Athens, OH (US); Khairul Alam, Athens, OH (US); Hajrudin Pasic, Athens, OH (US)

(73) Assignee: Ohio University, Athens, OH (US)

( * ) Notice: Subject to any disclaimer, the term of this patent is extended or adjusted under 35 U.S.C. 154(b) by 529 days.

(21) Appl. No.: 15/781,500

(22) PCT Filed: Dec. 8, 2016

(86) PCT No.: PCT/US2016/065587
§ 371 (c)(1),
(2) Date: Jun. 5, 2018

(87) PCT Pub. No.: WO2017/100433
PCT Pub. Date: Jun. 15, 2017

(65) Prior Publication Data

US 2018/0266062 A1 Sep. 20, 2018

Related U.S. Application Data

(60) Provisional application No. 62/265,050, filed on Dec. 9, 2015.

(51) Int. Cl.
*E01F 15/14* (2006.01)
*E01F 15/04* (2006.01)

(52) U.S. Cl.
CPC ..... *E01F 15/143* (2013.01); *E01F 15/145* (2013.01); *E01F 15/043* (2013.01); *E01F 15/0453* (2013.01)

(58) Field of Classification Search
CPC ..... E01F 15/14; E01F 15/141; E01F 15/143; E01F 15/145; E01F 15/146; E01F 15/148
See application file for complete search history.

(56) References Cited

U.S. PATENT DOCUMENTS 3,141,655 A 7/1964 Platt
3,473,836 A * 10/1969 Halter ..... B60R 19/18 293/107

(Continued)

FOREIGN PATENT DOCUMENTS

CN 203821230 U 9/2014
KR 20030086152 A 11/2003

OTHER PUBLICATIONS

International Search Report in International Patent Application No. PCT/US2016/065587, dated Feb. 23, 2017, 3 pgs.

(Continued)

*Primary Examiner* — Jonathan P Masinick
(74) *Attorney, Agent, or Firm* — Wood Herron & Evans LLP

(57) ABSTRACT

A force-absorbing barrier 10 includes a plurality of concentric chambers 21, 23, 25 and 27 at least partially filled with fluid 42. The walls 22, 24, 26 and 28 defining the chambers are flexible. Fluid passages 30 in the interior walls 24, 26 and 28 between chambers allow fluid flow between the chambers. The fluid flow from chamber to chamber will absorb energy from the impact a motor vehicle, preventing the vehicle from impacting the terminal of a guardrail.

9 Claims, 3 Drawing Sheets

(56) References Cited

U.S. PATENT DOCUMENTS 3,606,258 A * 9/1971 Fitch ..... E01F 15/146 256/13.1
4,073,482 A * 2/1978 Seegmiller ..... E01F 15/146 256/13.1
4,183,504 A * 1/1980 Ford ..... E01F 15/146 256/13.1
4,289,419 A * 9/1981 Young ..... E01F 15/146 404/6
4,645,375 A * 2/1987 Carney, III ..... E01F 15/146 188/377
5,391,016 A * 2/1995 Ivey ..... E01F 15/143 256/13.1
5,746,419 A * 5/1998 McFadden ..... B60R 19/18 188/377
5,791,811 A 8/1998 Yoshino
5,791,812 A * 8/1998 Ivey ..... E01F 15/143 256/13.1
5,823,584 A * 10/1998 Carney, III ..... B60R 19/00 293/102
5,957,616 A * 9/1999 Fitch ..... E01F 15/146 256/13.1
6,276,667 B1 * 8/2001 Arthur ..... E01F 15/0492 256/13.1
6,773,201 B2 * 8/2004 Witcher ..... E01F 15/065 404/10
6,905,281 B2 * 6/2005 Kang ..... E01F 15/146 404/6
7,478,796 B2 * 1/2009 Burkett ..... E01F 15/0438 256/13.1
7,575,391 B2 * 8/2009 Tarazona de La Asuncion ..... E01F 15/0461 188/371
8,974,142 B2 * 3/2015 Buehler ..... E01F 15/088 404/6
2004/0114996 A1 * 6/2004 Cicinnati ..... E01F 15/146 404/6
2006/0013651 A1 * 1/2006 Williams ..... E01F 15/0492 404/6

OTHER PUBLICATIONS

Written Opinion in International Patent Application No. PCT/US2016/065587, dated Feb. 23, 2017, 6 pgs.

* cited by examiner

GUARDRAIL TERMINAL BARRIER

BACKGROUND OF THE INVENTION

Automobile accidents are a common occurrence in daily driving activities. According to the National Highway Traffic Safety Administration (NHTSA), over 33,000 vehicle related fatalities were reported in 2012. With millions of vehicles on the road in the U.S. at any given time, improving transportation safety is always needed. Specific attention is needed in roadside guardrail barrier design. Over fifty percent of the fatalities reported in 2012 involved crashes where the vehicle left the roadway surface. Guardrails are designed to prevent vehicles from leaving the road surface and entering potentially dangerous off-road environments. Vehicles involved in side impact of guardrails are commonly redirected back onto the roadway. This often results in minimal injuries to drivers and other occupants. Studies on side collisions with guardrails have been conducted and include flared embankments, support post spacing, and guardrail position angle. In some cases, the collision occurs with the terminal, or end, of the guard rail. These collisions are severe and often result in fatalities. Over 1,000 fatalities were due to this type of collision.

Many guardrail end terminals have been used since guardrails became common roadside additions. The standard blunt end terminal was the most widely used early technology. This terminal provided little impact absorbing qualities and has been replaced in most areas by new designs.

The buried transition terminal eliminated the blunt end of the guardrail. However, its ramp-like structure proves to be as dangerous as the blunt end type. Collisions with these barrier terminals have the potential to deflect the vehicle back into traffic. In worse situations the vehicle can become airborne and leave the roadway altogether.

The third type, ET-2000, is the most common terminal end used today. It is designed to absorb impact energy by allowing the vehicle to follow the guardrail path and shear wooden support posts. The working mechanism of the terminal redirects the guardrail away from the vehicle as the impact occurs. This method works to an extent but its efficiency is questionable for high speed/energy collisions, in which the mechanism fails to work properly causing the deflector to jam and the guardrail to penetrate the vehicle.

Other previously proposed end treatments are the TWINY European end treatment, box-beam bursting end treatment, and kinking guardrail treatment. All of these terminals are designed to peel away the guardrail during impact similar to the ET-2000 end treatment described earlier. Although these designs show promising energy absorbing capacity, the potential exists for the mechanism to jam and penetrate the vehicle. This event is highly dangerous and often leads to severe injury or fatality.

SUMMARY OF THE INVENTION

The focus of the present invention is to provide a safer and more efficient solution to roadside guardrail terminal ends. To that end, the present invention provides a fluid-filled multichambered barrier as a guardrail terminal.

Transport of fluid across boundaries leads to higher energy absorption. The level of incompressibility and viscous effects of the fluid requires a significant amount of energy to move the fluid across membranes or through orifices. In addition to moving fluid across a boundary, the sloshing effect of the fluid within the container has potential to increase the energy absorbing efficiency of the structure.

Applying these fluid mechanics concepts to a barrier design allows fluid to flow between the chambers of the barrel to increase energy absorption of the structure during impact.

A multichambered fluid filled container with fluid passages between the chambers allows the fluid transport which in turn absorbs impact energy. The chambers are concentric, providing a fluid flow path from the outermost chamber sequentially to the inner chambers.

The invention will be further appreciated in light of the following detailed description and drawings in which:

DETAILED DESCRIPTION OF THE INVENTION

Figure 1:
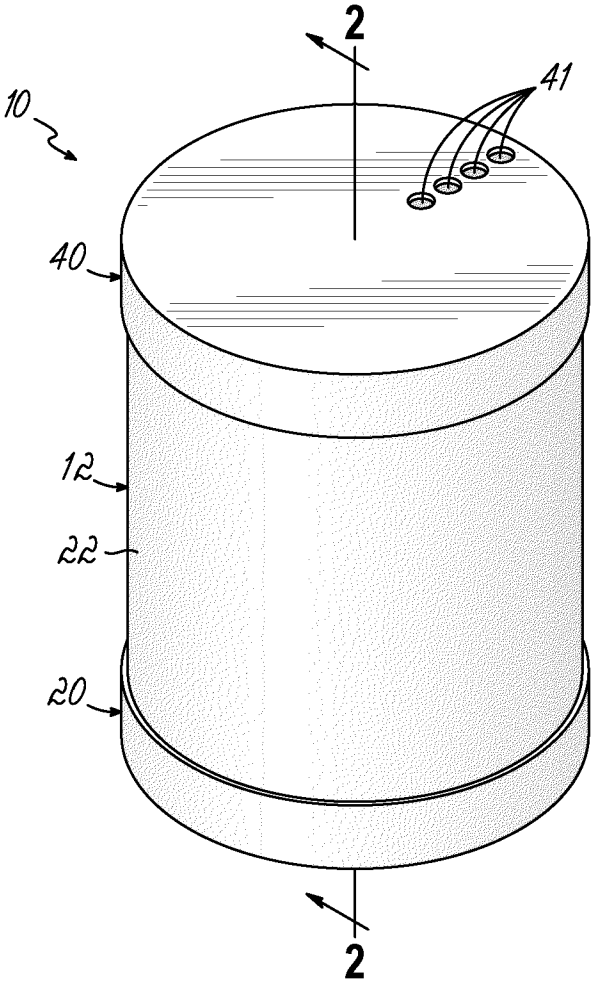
FIG. 1 is a perspective view of the present invention.
Figure 3:
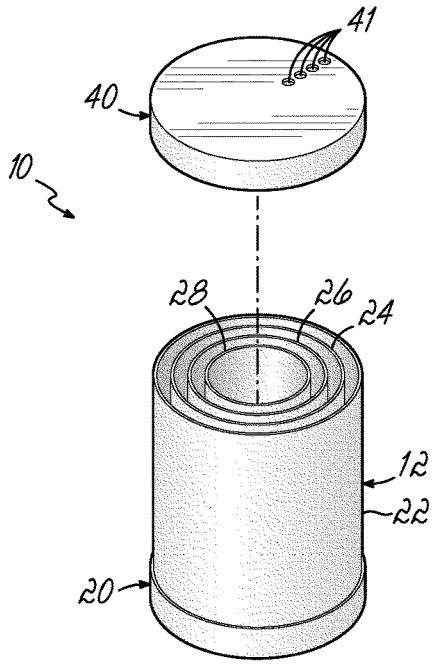
FIG. 3 is a perspective view of the present invention, similar to FIG. 1, with the top removed.
Figure 4:
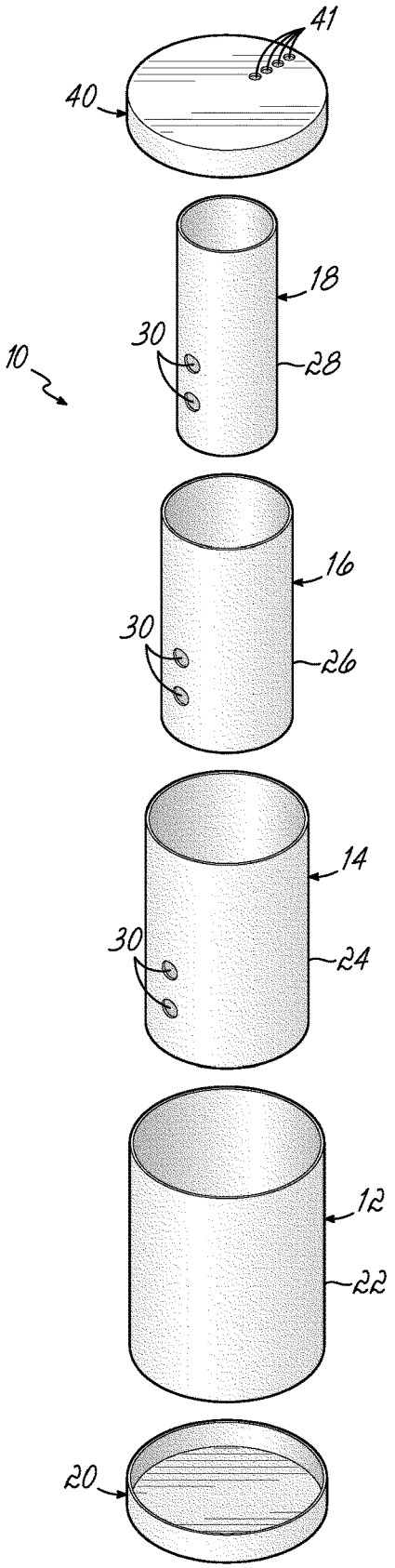
FIG. 4 is an exploded view of the present invention.

As shown in FIG. 1, a barrier 10 designed to absorb the impact of an automobile or other motor vehicle includes a plurality of concentric containers. As shown in FIG. 1, there is a first container 12, a second container 14, a third container 16 and a fourth container 18. All of these containers include a common base 20 and are formed from first exterior wall 22, second wall 24, third wall 26 and fourth wall 28. Although these can be distinct and separate containers, as shown the four walls which form the containers all share a common base 20 to which they are welded to form the containers. These walls define chambers 21, 23, 25 and 27.

The second, third and fourth containers each include a plurality of holes or fluid passages 30 which allow fluid to pass back and forth between the respective chambers. Finally, the barrier 10 includes a top 40 which is secured to the first exterior wall 22 of the first container 12. The top 40 can be secured to the wall 22 by a variety of different mechanisms. It can be snap-fitted, penetrating fasteners can be employed or the top 40 can be welded to the first wall 22. Air passages 41 allow for compression of the barrier 10. The air passages can be holes 41 through the top 40 as shown or a clearance between the top 40 and outer wall 20.

Fluid 42 is located within chambers 21, 23, 25 and 27. As shown, fluid 42 fills approximately half of the total internal area of barrier 10. The amount of fluid located within the barrier can be varied to maximize impact absorption. The fluid content can be as low as 20% of the interior, up to about 100% of the interior of barrier 10. Generally, it will fill 25% to 50% of this internal area.

The fluid can be any fluid which can resist environmental conditions, will not easily evaporate and further is not a fire hazard. For example, the fluid can be water in combination with antifreeze or can be other liquids, such as glycols, oils and the like. An increased viscosity will increase the energy absorption of the barrier 10. Therefore, the fluid can be a combination of chemicals which are designed to provide a fluid more viscous than water. A rainwater collector (not shown) can be used to direct water to the barrier.

The barrier can be formed from any material that will flex upon impact and not break during impact. It can, for example, be high molecular weight polyethylene or other polymers. Further, it can be a flexible metal such as aluminum metal alloy or the like.

The size of the barrier can be varied. The approximate minimum diameter is approximately 1 foot up to about 3 feet. Further, the height of the barrier should be the least about 2 feet and preferably 3 feet to 5 feet or more.

As shown, the barrier is a cylinder, however, it can be different shapes, depending upon the desired placement of the barrier. For example, it could have an octagonal, hexagonal, triangular and even rectangular horizontal cross-section.

The holes 30 in walls 24, 26 and 28 are designed to allow controlled fluid flow from chamber 21 into chamber 23 and from chamber 23 to chamber 25 and subsequently to chamber 27. The diameter of these holes will vary depending on the size of barrier 10 as will the viscosity of the fluid and the number of holes per wall. Although the upper and lower limits may vary significantly, it is generally contemplated that there will be 0.25 to 2 inches in diameter.

As shown, the holes are in the lower portion of the barrier, in the fluid containing portion. Additional holes above the fluid level may also be provided if desired. A greater total area of the holes reduces the resistance to fluid flow, reducing peak force.

Figure 5:
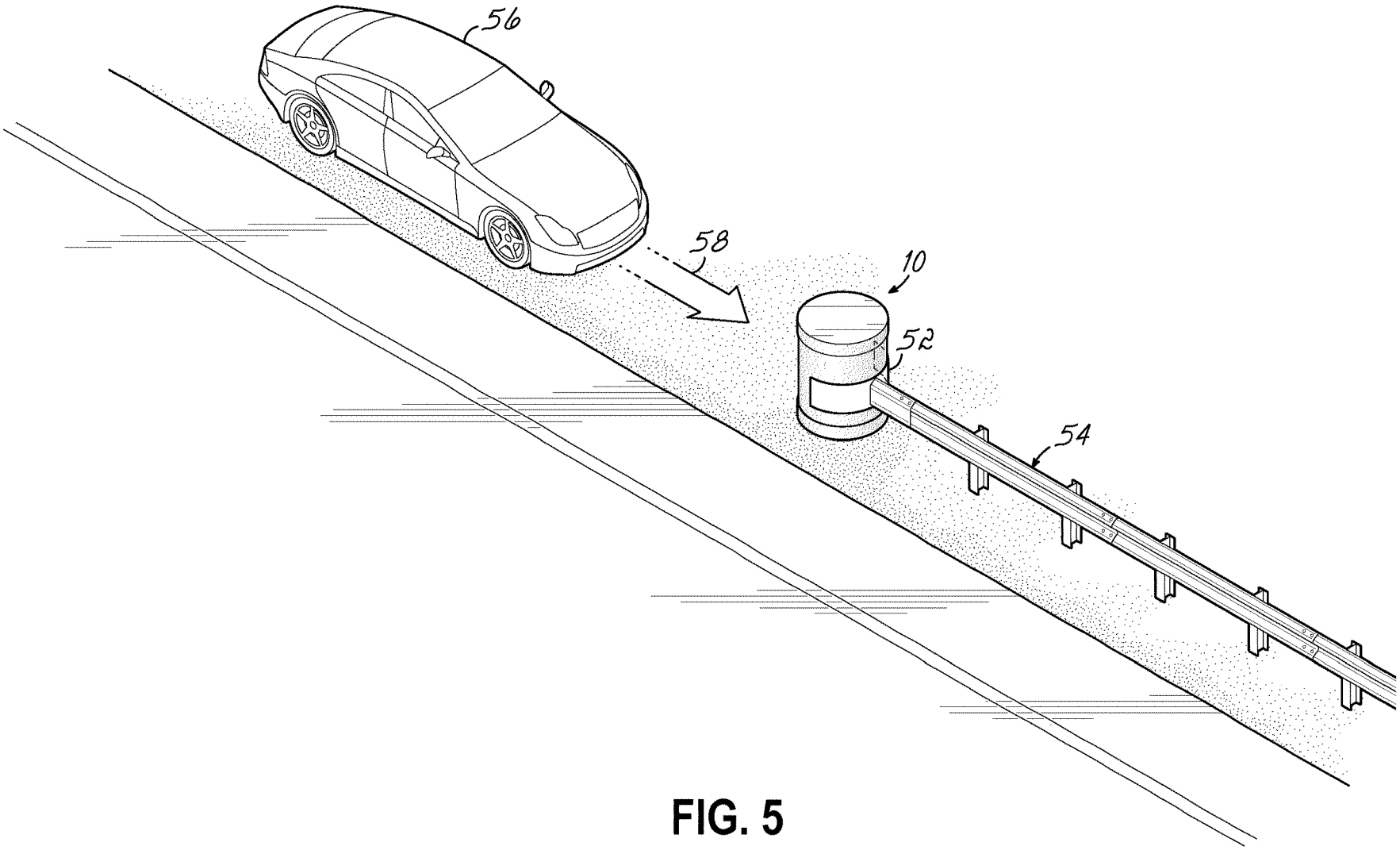
FIG. 5 is a perspective view of the present invention in its intended environment.

The barriers of the present invention will typically be placed in positions to prevent automobiles and the like from being severely damaged upon impact of a structure. These can be, for example, in front of the piers of a bridge or, as shown in FIG. 5. As shown in FIG. 5, three different barriers are employed. These are placed next to a curved plate 52 attached to guardrail 54. More barriers could be employed if desired.

Figure 2:
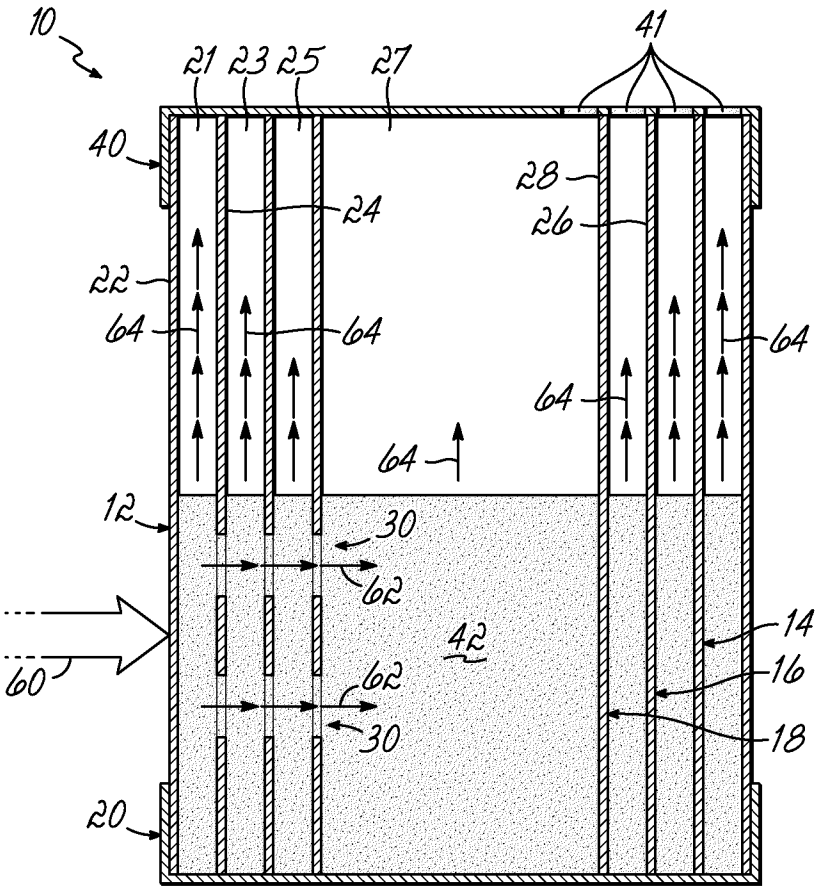
FIG. 2 is a cross-sectional view taken at lines 2-2 of FIG. 1.

FIG. 2 and FIG. 5 demonstrate the manner in which the barriers of the present invention will absorb energy upon impact. As a car 56 approaches the barriers 10 into the direction of arrows 58 and strikes the barriers 10, the energy represented by arrow 60 (see FIG. 2) will force initially the first wall 22 and subsequently the second, third and fourth walls inwardly. This will act to compact the fluid 42 within the barrier, forcing the fluid in area 21 into area 23 and then into area 25 and subsequently area 27, as shown by arrows 62. Also, the fluid in the chambers will rise as shown by arrows 64. This requires energy to move the fluid. All of this fluid movement absorbs the energy of the collision, slowing the vehicle down and keeping the vehicle from reaching the guardrail 54. As will be demonstrated in the following example, utilizing multiple compartments of liquid with fluid passages between the compartments absorbs more energy than a single container without any internal barriers or the like.

Example

The following experiment demonstrated the efficiency of the present invention. A horizontal impact tester accelerates a 4.4 kg sled up to 3 m/s providing impact energy up to 20 J. The apparatus was outfitted with an accelerometer to measure the acceleration pulse during the impact and high speed camera to measure the displacement and velocity of the ram.

Test samples were constructed using 32 oz. plastic jars as the primary structure (4 in. diameter, 6.5 in. height) and smaller 8 oz. containers for the internal structures (2.25 in. diameter, 4.5 in. height). Orifices were placed on the internal structures to allow for fluid transport between the chambers. The placement of the orifices on the internal structures is shown. Testing criteria for the samples included: primary structure, primary structure with interior structure (no orifices), primary structure with interior structure (one orifice), primary structure with interior structure (two orifices), and primary structure with interior structure (three orifices). Each of these five configurations was tested with fluid levels of empty, quarter-filled, half-filled, three quarter-filled, and filled. A single hole was drilled on top cap in all samples to allow liquid to move.

The filled sample without an interior bottle prevented the movement of interior fluid because the fluid does not have any space to travel. This results in a large initial spike in reaction forces experience by the ram. The quarter-filled sample with two orifices on the interior bottle had adequate void space for the fluid to travel, hence allowing momentum to be transferred to the fluid and redirected throughout the structure. The initial impact causes the fluid to flow upwards along the front side of the sample. This thin film of fluid not only accepts the energy transfer but momentarily provides additional stiffness to the structure, which assists in additional energy absorption. Further momentum transfer to the fluid can be seen as the thin wall of fluid breaks and flows around the interior structure as well as through orifices. The void space of the quarter-filled sample allows for a more efficient energy transfer to the fluid and throughout the structure via exterior and interior bottle crush, movement of the water between the bottles, and forced flow of water through orifices, resulting in approximately 50% of the peak reaction force of the filled sample while giving up an additional 50% displacement.

A quarter-filled barrier allows for greater fluid movement than the filled sample. This allows for more energy transfer from the impact ram to the fluid and is then redirected away from the impact direction. This results in lower peak forces while maintaining the ability to absorb the entire impact energy. Table 1 shows the results of the two samples in comparison.

TABLE 1

Results of filled sample without interior bottle and quarter-filled sample with two orifices:

| Fluid Level | Interior Bottle | Orifices | Max Displacement cm | Peak Force N | Efficiency J/kN | Capacity J/cm |
|---|---|---|---|---|---|---|
| Filled | NO | N/A | 2.5 | 1605.8 | 7.03 | 4.52 |
| ¼ Filled | YES | 2 | 3.7 | 861.2 | 14.22 | 3.29 |

Upon completion of testing, two parameters were developed to describe the behavior of the sample during impact. The first was efficiency, energy absorbed per unit force (kN) imparted on the impact ram. The second parameter, capacity, is energy absorbed per unit displacement (cm). The empty samples had the lowest average peak forces but resulted in the lowest capacities. The filled samples had the highest capacity but also imparted the highest peak forces. The sample configuration that performed best was the sample with two orifices and quarter-filled with water. This sample had an efficiency of 14.22 J absorbed per kN of reactive force. This resulted in an efficiency increase that is more than double as compared to the filled sample without interior bottle. Its capacity was near average at 3.29 J absorbed per cm of displacement.

Tests were performed on a bottle with an interior bottle (one orifice) for fluid levels of quarter-filled, half-filled and three-quarter-filled. For this group of samples and the remaining samples, the empty and filled samples were not included in analysis. This was due to the empty samples having the lowest capacity and the filled samples having the highest peak forces and lowest efficiency. The results for energy absorbed, peak force, maximum displacement, efficiency and capacity are shown below in Table 2.

TABLE 2

Energy and peak force results for the bottle with interior bottle (one orifice). (E/F is energy absorbed/unit force. Units are J/kN. E/D is energy absorbed/unit displacement. Units are J/cm.)

| | Interior Bottle (1 orifice) | | | | |
|---|---|---|---|---|---|
| | Total Energy (J) | Peak Force (N) | Max Displacement (cm) | E/F | E/D |
| ¼ filled | 10.5438 | 1012.5588 | 3.33 | 10.4130 | 3.1711 |
| ½ filled | 10.6694 | 1038.3400 | 3.30 | 10.2754 | 3.2332 |
| ¾ filled | 12.8402 | 1196.8572 | 3.17 | 10.7283 | 4.0569 |

The results in Table 2 above show that the three-quarter-filled sample has the highest efficiency, E/F value of 10.7283 J/kN. This sample also has the highest capacity, E/D value of 4.0569 J/cm. The three-quarter-filled sample does have the highest peak force (1196.8572 N) of the group, but its highest efficiency and capacity values make this sample the best selection of the group.

Tests were performed on the bottle with an interior bottle (two orifices) for fluid levels of quarter-filled, half-filled and three-quarter-filled. Again, the empty and filled samples were excluded from analysis because of their low efficiency and capacity potential. The results for energy absorbed, peak force, maximum displacement, efficiency and capacity are shown below in Table 3.

TABLE 3

Energy and peak force results for the bottle with interior bottle (2 orifices). (E/F is energy absorbed/unit force. Units are J/kN. E/D is energy absorbed/unit displacement. Units are J/cm.)

| | Interior Bottle (2 orifices) | | | | |
|---|---|---|---|---|---|
| | Total Energy (J) | Peak Force (N) | Max Displacement (cm) | E/F | E/D |
| ¼ filled | 12.2454 | 861.1988 | 3.72 | 14.2191 | 3.2918 |
| ½ filled | 11.9422 | 1073.7276 | 3.42 | 11.1222 | 3.4970 |
| ¾ filled | 11.9986 | 1053.4392 | 2.93 | 11.3899 | 4.0951 |

The sample with the highest efficiency is the quarter-filled sample with an E/F value of 14.2191 J/kN. This samples has the lowest peak force of 861.1988 N. The three-quarter-filled sample has the highest capacity, E/D value of 4.0951 J/cm. This sample has the second highest peak force of 1053.4392 N. The quarter-filled sample is the best choice of the group since its efficiency is highest and has a capacity of 3.2918 J/cm.

Lastly, tests were performed on the bottle with an interior bottle (3 orifices) for fluid levels of quarter-filled, half-filled and three-quarter-filled. The empty and filled samples were excluded from analysis because of their low efficiency and capacity potential. The results for energy absorbed, peak force, maximum displacement, efficiency and capacity are shown below in Table 4.

TABLE 4

Energy and peak force results for the bottle with interior bottle (3 orifices). (E/F is energy absorbed/unit force. Units are J/kN. E/D is energy absorbed/unit displacement. Units are J/cm.)

| | Interior Bottle (3 orifices) | | | | |
|---|---|---|---|---|---|
| | Total Energy (J) | Peak Force (N) | Max Displacement (cm) | E/F | E/D |
| ¼ filled | 11.5698 | 1018.2128 | 3.50 | 11.3629 | 3.3047 |
| ½ filled | 10.7892 | 1106.3756 | 3.28 | 9.7518 | 3.2894 |
| ¾ filled | 10.8540 | 1048.0360 | 3.12 | 10.3565 | 3.4844 |

The above results show that the quarter-filled sample has the highest efficiency, E/F value of 11.3629 J/kN. This sample also has the lowest peak force imparted on the ram of 1018.2128 N. The three-quarter-filled sample has the highest capacity, E/D value of 3.4844 J/cm. This sample does show a slight increase in peak force at 1048.0360 N. The quarter-filled sample is the best choice of this group because it has the highest efficiency and lowest peak force. Its capacity is also second highest at 3.3047 J/cm.

The above demonstrates that a multichamber fluid containing barrier with fluid passages between the chamber walls efficiently absorbs impact energy. This provides a safety barrier for guardrails and other highway structures.

What is claimed is:

1. An impact absorbing barrier comprising:

a first wall and a second wall;

a first chamber between said first wall and said second wall and a second chamber within said second wall, wherein one of said first chamber and said second chamber is positioned concentrically within the other of said first chamber and said second chamber;

a fluid in said first chamber and said second chamber and a first fluid passage in said second wall which permits fluid flow from said first chamber into said second chamber;

whereby compression of said first wall forces said fluid in said first chamber through said first fluid passage into said second chamber, thereby absorbing energy.

2. The impact absorbing barrier claimed in claim 1 further comprising a third wall positioned in said second chamber establishing a third chamber within said third wall, said third wall including a second fluid passage from said second chamber to said third chamber;

whereby compression of said second wall forces fluid from said second chamber through said second fluid passage in said third wall, thereby absorbing energy.

3. The impact absorbing barrier claimed in claim 1 wherein said first and second walls are formed from polyethylene.

4. The impact absorbing barrier claimed in claim 1 wherein 25 to 75% of an interior area of said barrier is filled with said fluid.

5. The impact absorbing barrier claimed in claim 1 wherein said fluid is selected from the group consisting of water and oil.

6. The impact absorbing barrier claimed in claim 1 wherein said first and second walls are cylinders, and said cylinders are attached to a common base.

7. The barrier claimed in claim 1 having a height of 2 to 5 feet and a diameter of 1 to 3 feet.

8. The barrier claimed in claim 1 positioned on a highway forward of a guardrail or pier.

9. The barrier claimed in claim 8 wherein said barrier rests against a curved plate fixed to said guardrail or pier.

* * * * *